US011168708B2

(12) United States Patent
Lee et al.

(10) Patent No.: US 11,168,708 B2
(45) Date of Patent: Nov. 9, 2021

(54) TIME-BASED POWER BOOST CONTROL SYSTEM

(71) Applicant: Volvo Construction Equipment AB, Eskilstuna (SE)

(72) Inventors: Sanghee Lee, Gyeongsangnam-do (KR); Haeyong Park, Daegu (KR)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 16/647,919

(22) PCT Filed: Sep. 21, 2017

(86) PCT No.: PCT/KR2017/010418
§ 371 (c)(1),
(2) Date: Mar. 17, 2020

(87) PCT Pub. No.: WO2019/059431
PCT Pub. Date: Mar. 28, 2019

(65) Prior Publication Data
US 2020/0263708 A1 Aug. 20, 2020

(51) Int. Cl.
*F15B 11/028* (2006.01)
*F15B 13/042* (2006.01)
(Continued)

(52) U.S. Cl.
CPC ..... *F15B 11/028* (2013.01); *F15B 13/042* (2013.01); *F15B 20/007* (2013.01);
(Continued)

(58) Field of Classification Search
CPC ..... F15B 21/02; F15B 21/10
See application file for complete search history.

(56) References Cited

U.S. PATENT DOCUMENTS 4,317,466 A * 3/1982 Ikeda ..... F15B 11/02 137/115.13
8,353,157 B2 * 1/2013 Lech ..... F15B 21/082 60/452
(Continued)

FOREIGN PATENT DOCUMENTS

JP 11336705 A * 12/1999 ..... F15B 11/028
JP 2017008980 A 1/2017

OTHER PUBLICATIONS

International Search Report and Written Opinion of the International Searching Authority, PCT/KR2017/010418, dated Jun. 19, 2018, 16 pages.

*Primary Examiner* — Michael Leslie
(74) *Attorney, Agent, or Firm* — Sage Patent Group

(57) ABSTRACT

A time-based power boost control system. A fluid source supplies fluid. A relief device relieves pressure of the fluid supplied by the fluid source when the pressure of the fluid exceeds a relief pressure level. A control device controls the relief device. When a boost mode in which at least a first level of pressure and a second level of pressure, higher than the first level of pressure, are allowed to be selectively used as the relief pressure level is active, a length of a boost-on time in which the second level of pressure is used as the relief pressure level is shorter than a preset maximum boost-on time limit, and a length of a succeeding boost-off time succeeding the boost-on time in which the first level of pressure is used as the relief pressure level is equal to or longer than a preset minimum boost-off time limit.

15 Claims, 9 Drawing Sheets

(51) Int. Cl.

| | |
|---|---|
| ***F15B 20/00*** | (2006.01) |
| ***F15B 21/02*** | (2006.01) |
| ***F15B 21/10*** | (2006.01) |

(52) U.S. Cl.

CPC ..... *F15B 21/02* (2013.01); *F15B 21/10* (2013.01); *F15B 2211/50518* (2013.01); *F15B 2211/526* (2013.01); *F15B 2211/6658* (2013.01); *F15B 2211/76* (2013.01)

(56) References Cited

U.S. PATENT DOCUMENTS

| | | | | |
|---|---|---|---|---|
| 8,875,506 | B2 * | 11/2014 | Hennemann ..... | E02F 9/2235 60/468 |
| 9,273,700 | B2 * | 3/2016 | Bergemann ..... | F15B 1/02 |
| 10,202,741 | B2 * | 2/2019 | Kang ..... | F15B 7/003 |
| 2002/0112475 | A1 | 8/2002 | Cannestra | |
| 2005/0129531 | A1 | 6/2005 | Fenny et al. | |
| 2013/0263587 | A1 | 10/2013 | Azuma et al. | |
| 2017/0203749 | A1 | 7/2017 | Imai et al. | |

* cited by examiner

[Fig. 1]
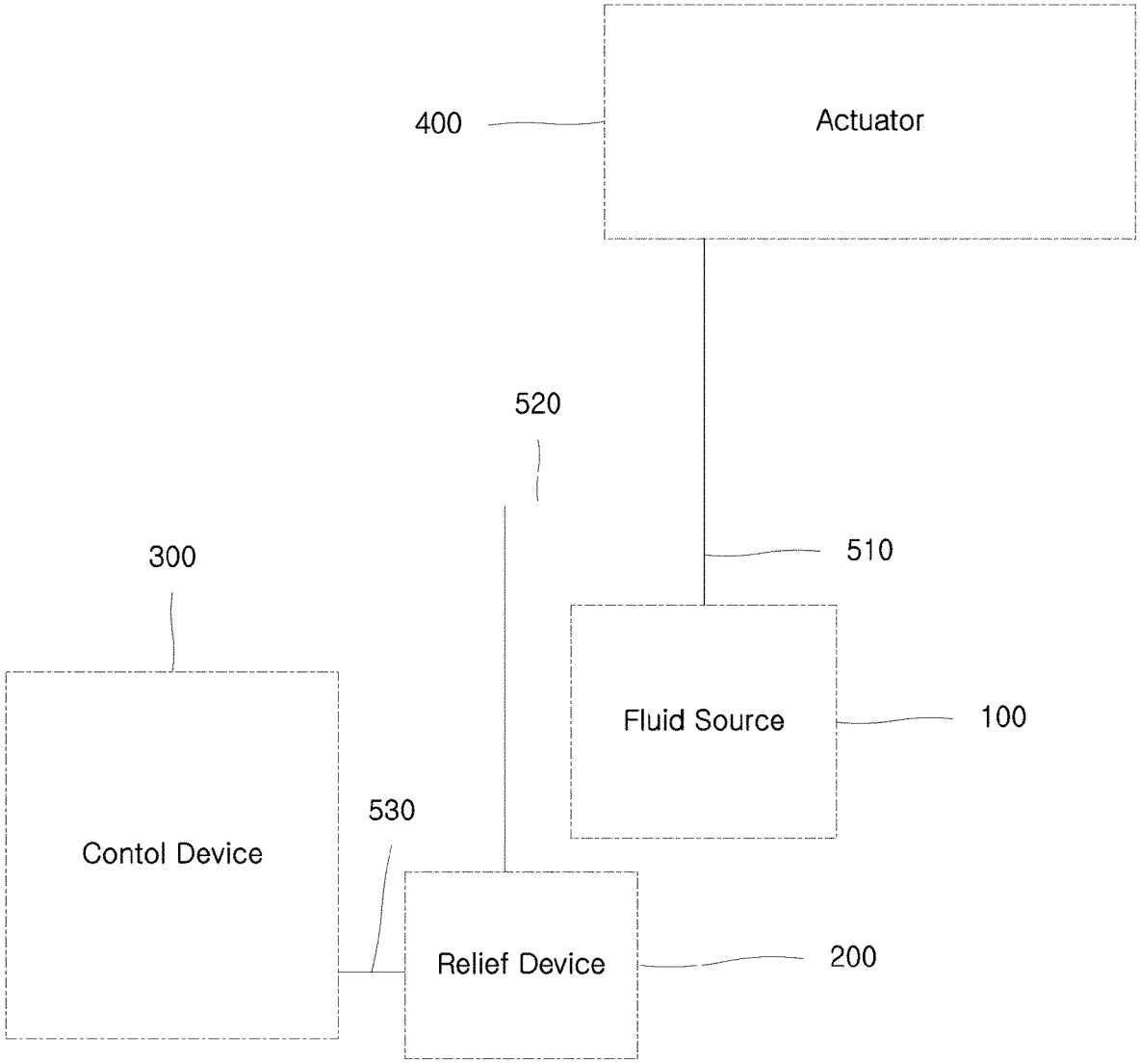

[Fig. 2]
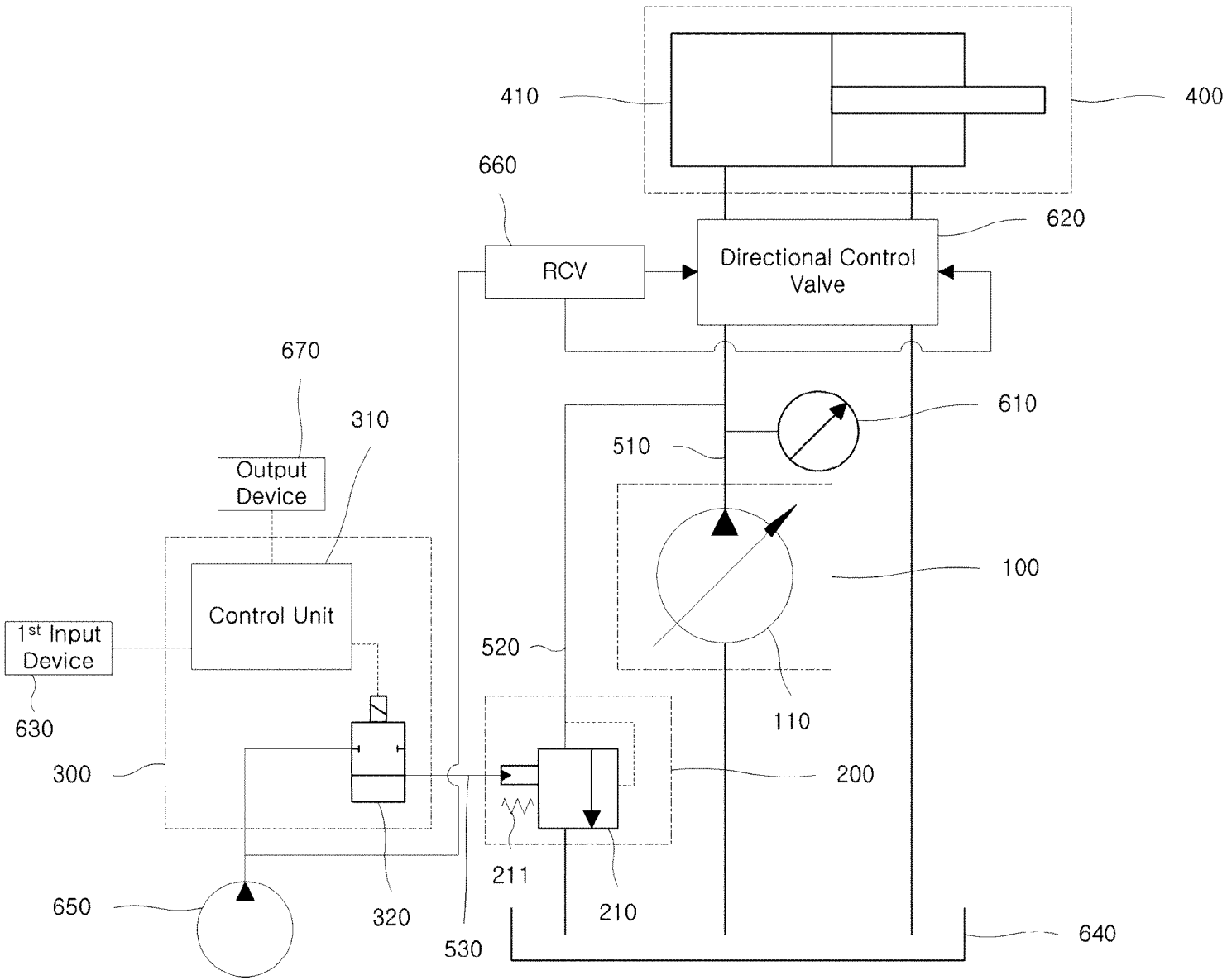

[Fig. 3]
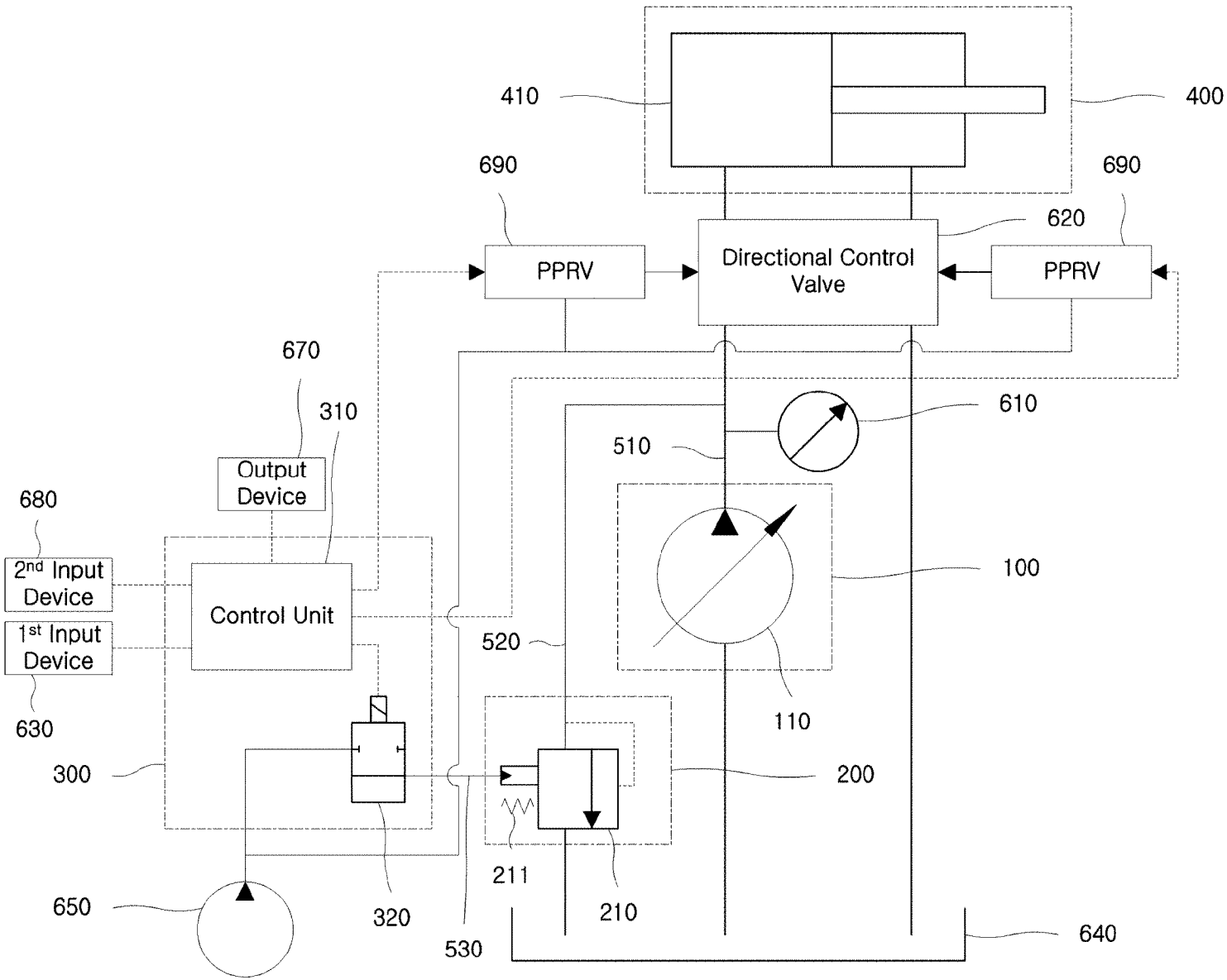

[Fig. 4]
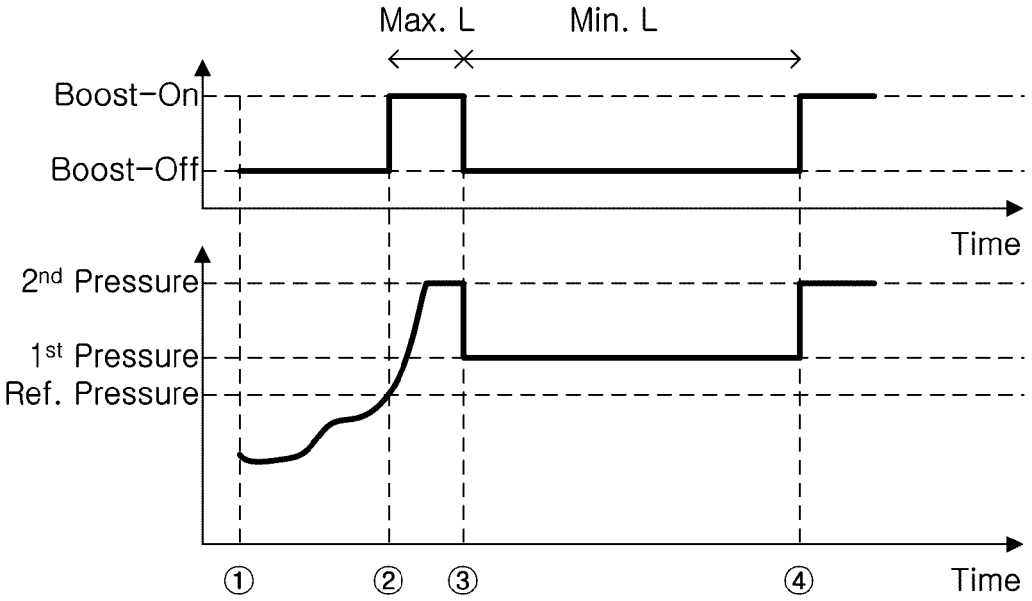
[Fig. 5]
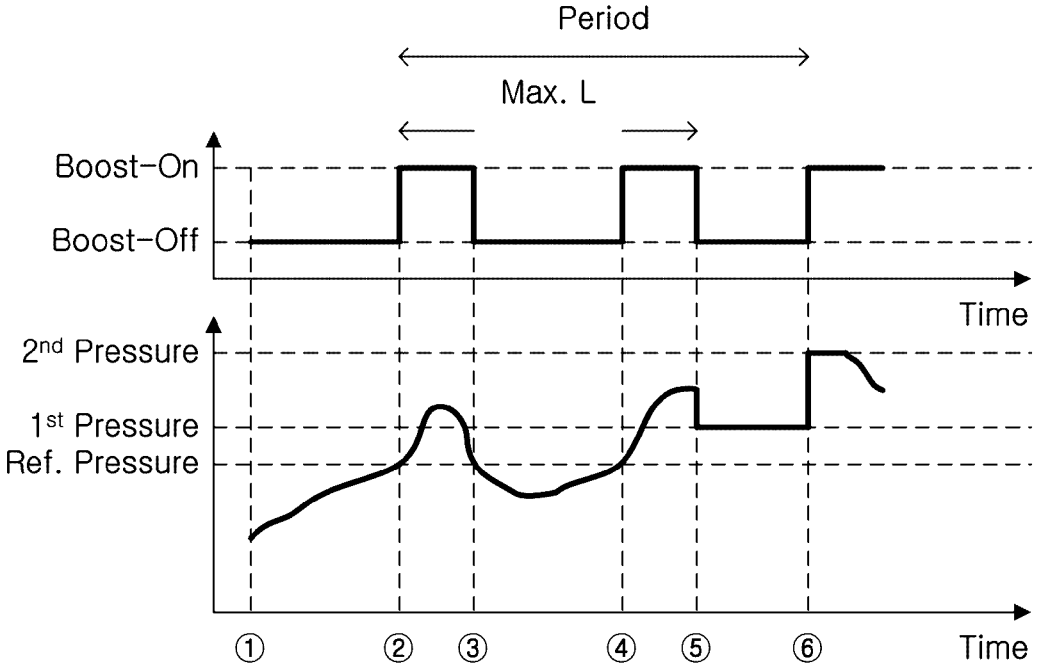

[Fig. 6]
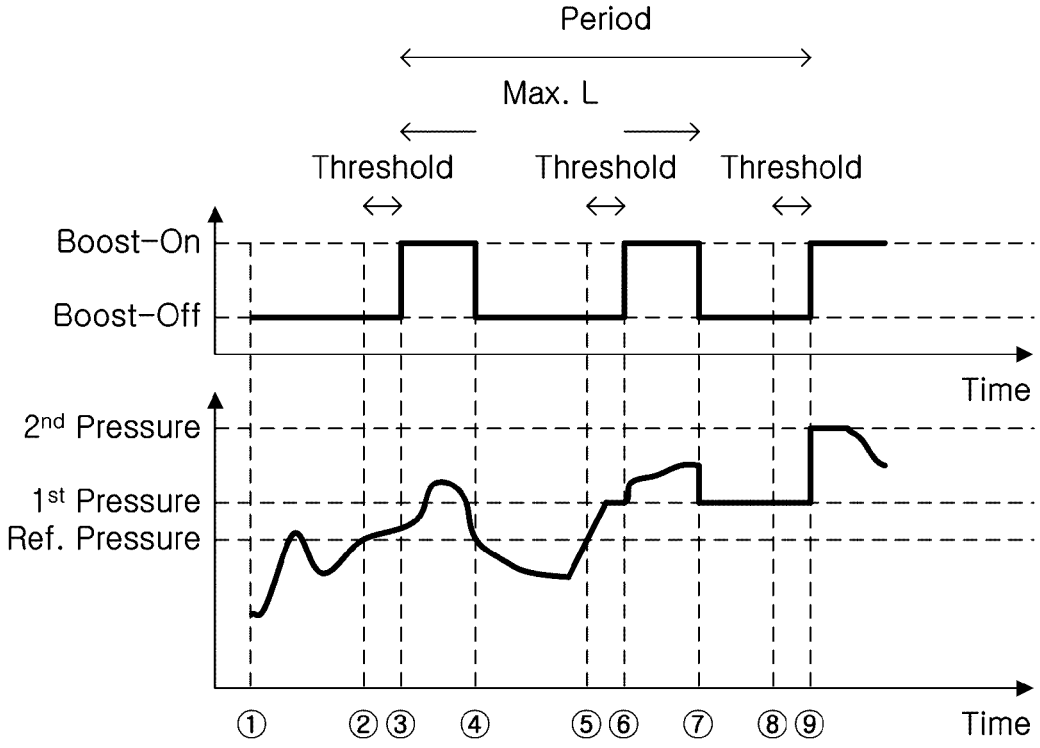

[Fig. 7]
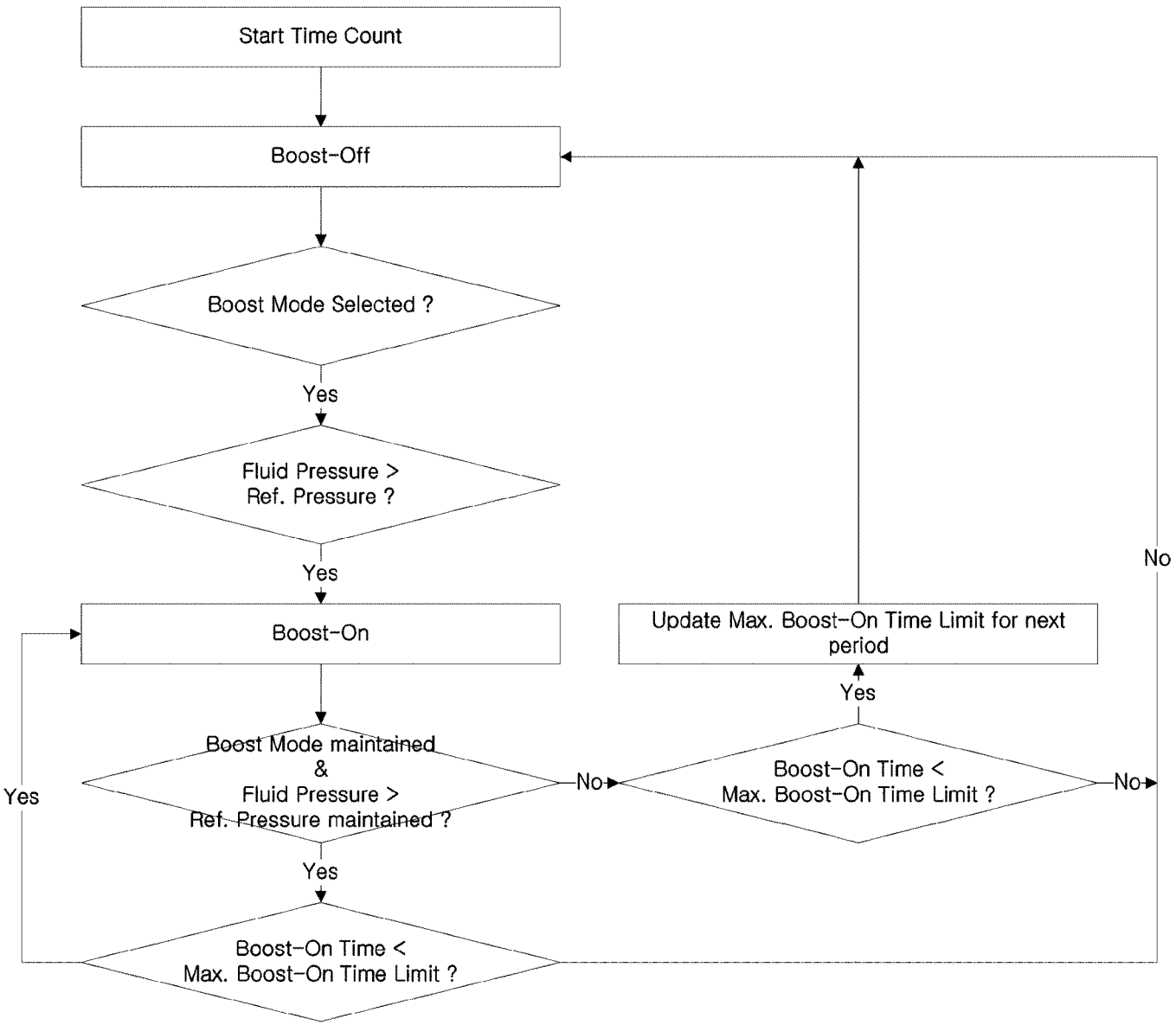

[Fig. 8]
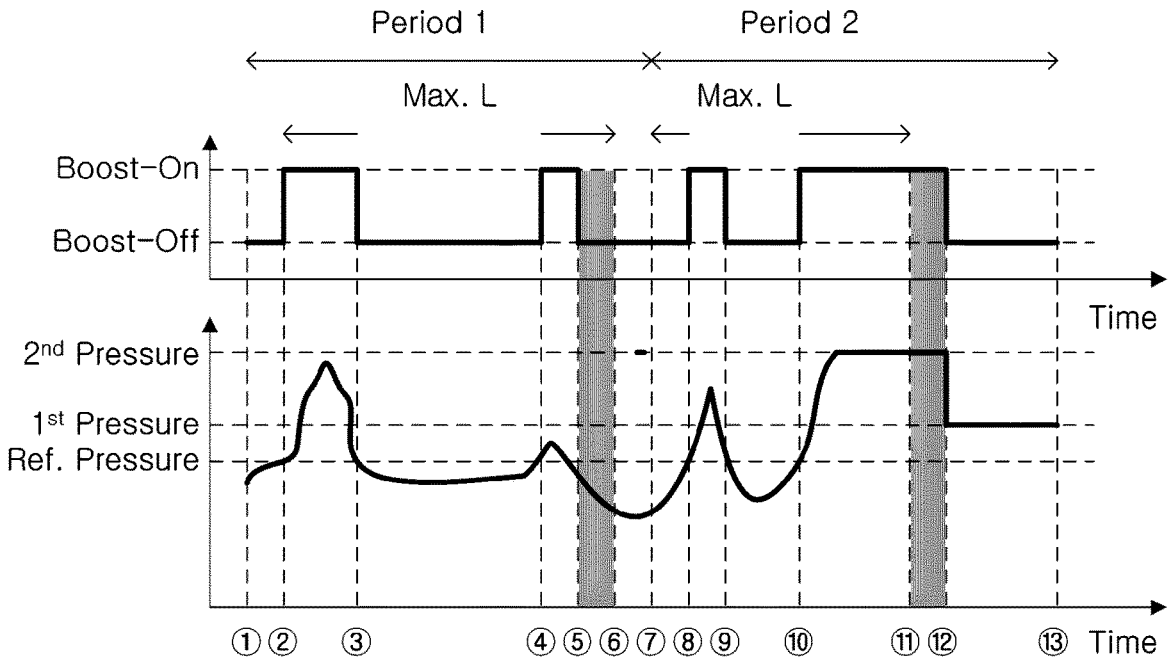
[Fig. 9]
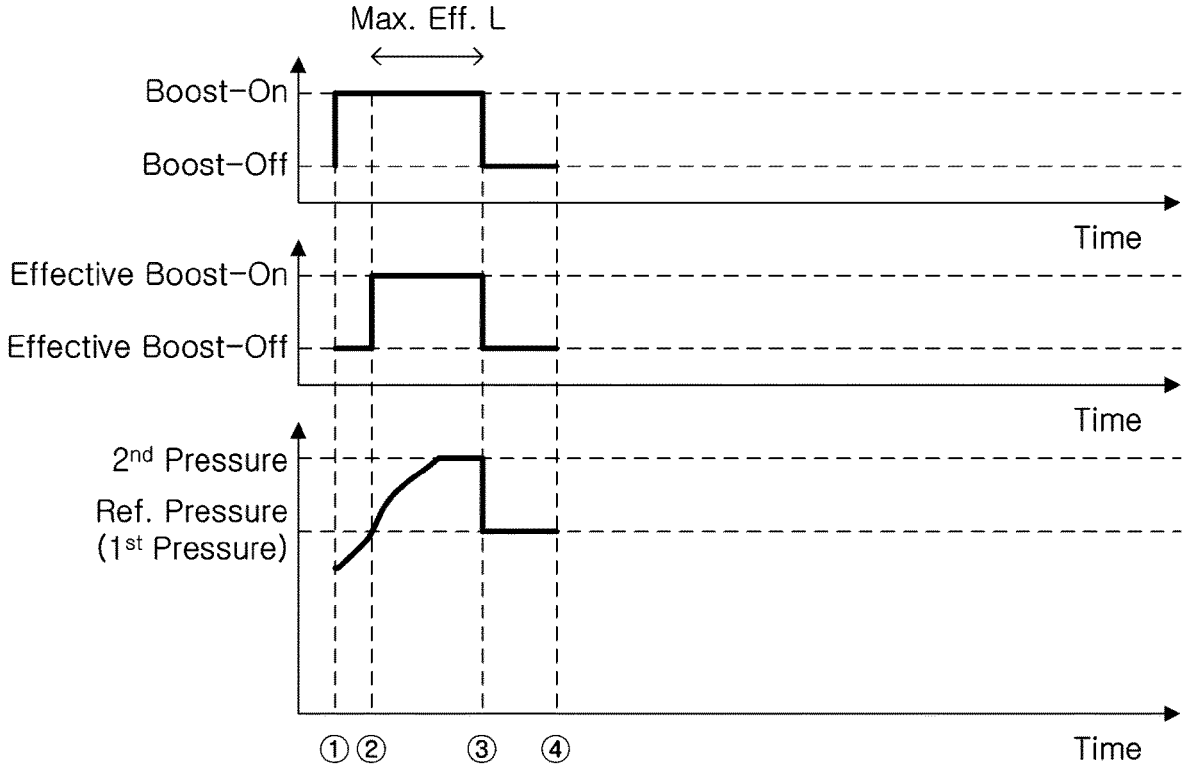

[Fig. 10]
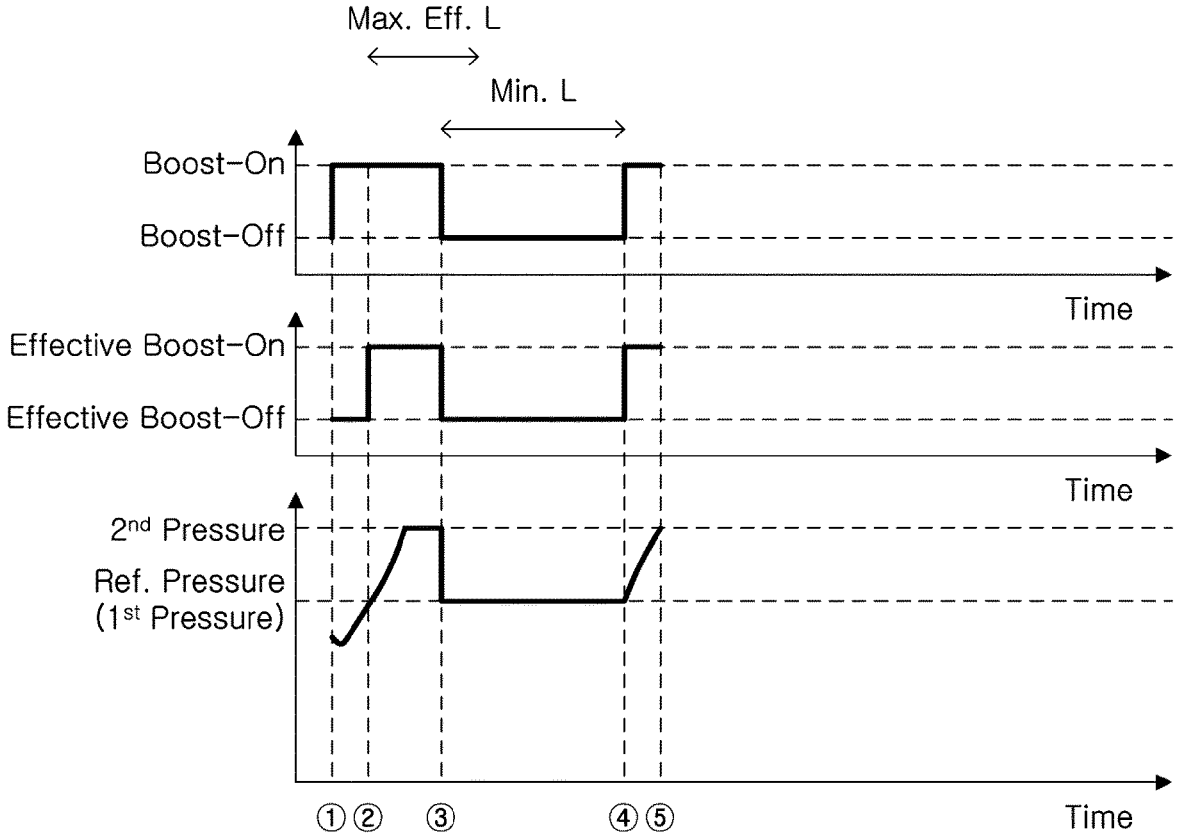
[Fig. 11]
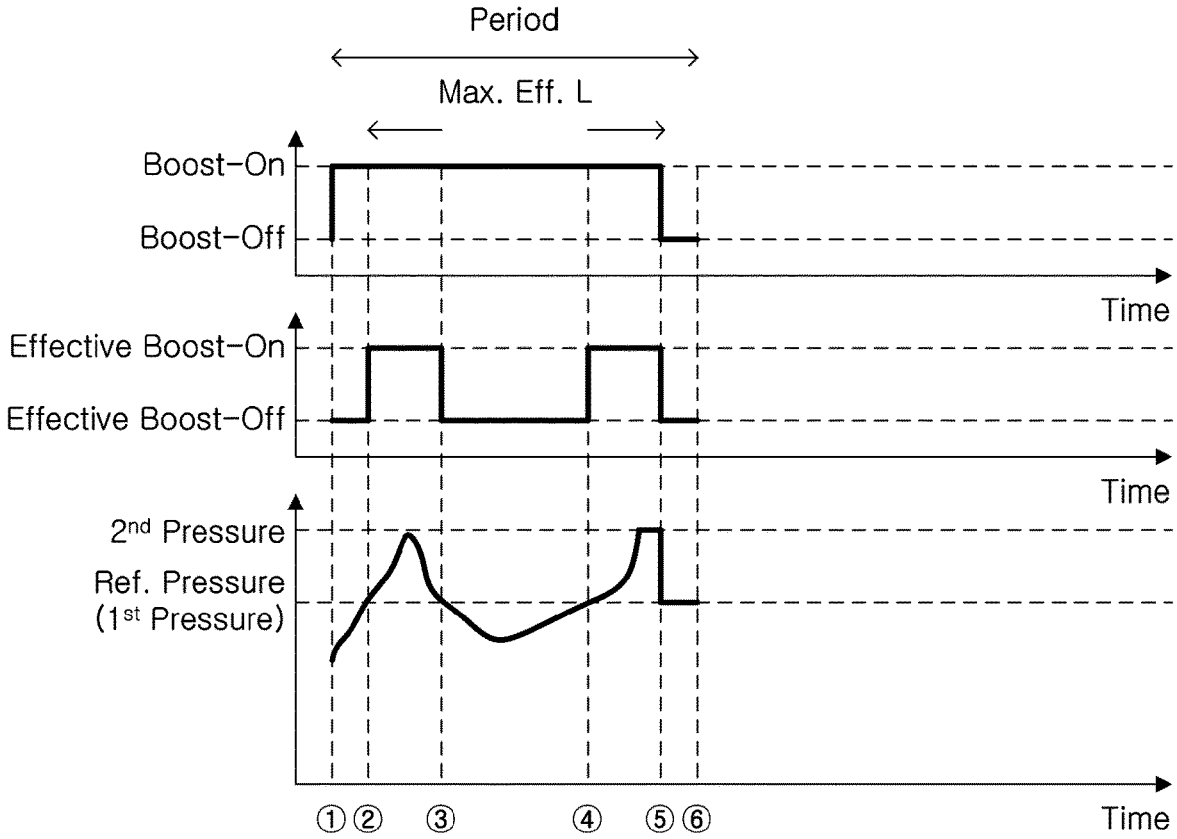

[Fig. 12]
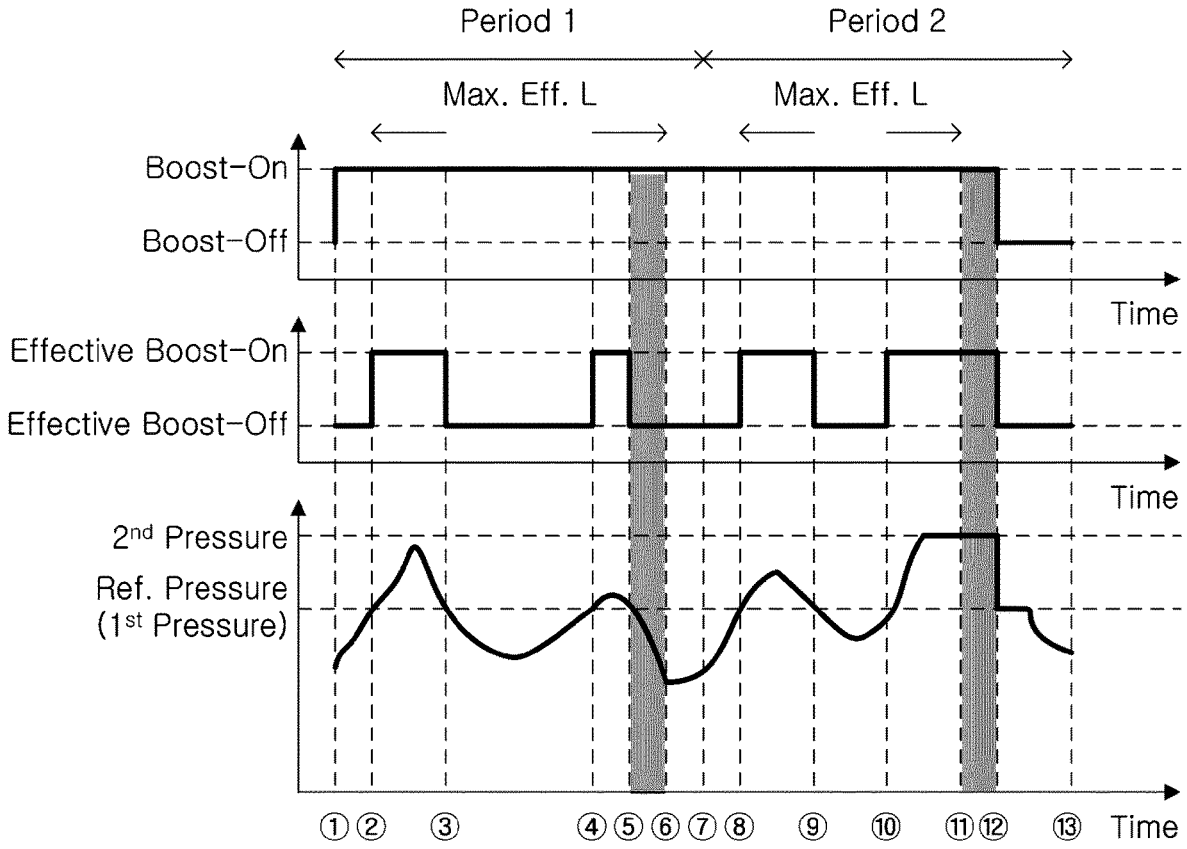

TIME-BASED POWER BOOST CONTROL SYSTEM

CROSS REFERENCE TO RELATED APPLICATIONS

This application is a 35 U.S.C. § 371 national stage application of PCT International Application No. PCT/KR2017/010418 filed on Sep. 21, 2017, the disclosure and content of which is incorporated by reference herein in its entirety.

TECHNICAL FIELD

The present disclosure relates to a power boost control system and, more particularly, to a time-based boost control system for performing power boost-on/off control based on time.

BACKGROUND ART

A variety of machines generating power using pressurized fluid are used in construction sites, in various industrial fields, and the like. For example, such machines supply pressurized fluid to an actuator, which in turn works using the pressure of the fluid. Since the pressure of the fluid inevitably changes during the work, components to which the pressure of the fluid is applied may be damaged when the pressure of the fluid is raised to be excessively high. Thus, a relief device, such as a relief valve, for preventing the constitutional devices from being damaged by relieving the pressure of fluid that has been increased to a level equal to or greater than a predetermined amount of pressure is provided.

However, when a large external load is temporarily applied to an actuator during working, the actuator may not be able to overcome the load with the relief valve, so that work may be undesirably limited. To overcome such limited working situations, a power boost control system for boosting a relief pressure level may be provided.

Such a power boost control system is generally configured such that as soon as a user activates a boost mode, the relief device is boosted (boost-on) and, after the lapse of a preset amount of time, the boosting of the relief device is turned off (boost-off). Thus, to boost the relief device, the user must manually activate the boost mode every time it is required, which may be problematic.

DISCLOSURE OF INVENTION

Technical Problem

Accordingly, the present disclosure has been made in consideration of the above-described problems occurring in the related art, and the present disclosure proposes a power boost control system with no need to manually activate a boost mode every time it is required. Also provided is a power boost control system able to realize power boosting performance as required while preventing deterioration in durability of constitutional devices.

Solution to Problem

According to an aspect of the present disclosure, a time-based power boost control system may include: a fluid source configured to supply fluid; a relief device configured to relieve pressure of the fluid supplied by the fluid source when the pressure of the fluid exceeds a relief pressure level; and a control device configured to control the relief device such that, when a boost mode in which at least a first level of pressure and a second level of pressure, higher than the first level of pressure, are allowed to be selectively used as the relief pressure level is active, a length of a boost-on time in which the second level of pressure is used as the relief pressure level is shorter than a preset maximum boost-on time limit, and a length of a succeeding boost-off time succeeding the boost-on time in which the first level of pressure is used as the relief pressure level is equal to or longer than a preset minimum boost-off time limit.

According to another aspect of the present disclosure, a time-based power boost control system may include: a fluid source configured to supply fluid; a relief device configured to relieve pressure of the fluid supplied by the fluid source when a level of the pressure of the fluid exceeds a relief pressure level; and a control device configured to set a time period and control the relief device such that, when a boost mode in which at least a first level of pressure and a second level of pressure, higher than the first level of pressure, are allowed to be selectively used as the relief pressure level is active, a cumulative length of at least one boost-on time over the time period in which the second level of pressure is used as the relief pressure level is shorter than a maximum boost-on time limit.

According to another aspect of the present disclosure, a time-based power boost control system may include: a fluid source configured to supply fluid; a relief device configured to relieve pressure of the fluid supplied by the fluid source when the level of the pressure of the fluid exceeds a relief pressure level; and a control device configured to control the relief device such that, when a boost mode in which at least a first level of pressure and a second level of pressure, higher than the first level of pressure, are allowed to be selectively used as the relief pressure level is active, the second level of pressure is used as the relief pressure level by default, and the first level of pressure is used as the relief pressure level when a cumulative length of at least one effective boost-on time in which the level of the pressure of the fluid exceeds a preset reference pressure level reaches a preset maximum effective boost-on time limit.

The time-based power boost control system may further include a fluid passage extending from the fluid source, wherein the fluid source includes a hydraulic pump of construction machinery, and the relief device includes a relief valve connected to the fluid passage.

The control device may include a control unit and a control valve selectively applying hydraulic pressure to the relief device under control of the control unit.

The time-based power boost control system may further include an input device by which an operator activates or in-activates the boost mode.

BRIEF DESCRIPTION OF DRAWINGS

FIG. 1 is a block diagram schematically illustrating the configuration of a power boost control system according to embodiments;

FIG. 2 schematically illustrates the configuration of a power boost control system according to embodiments;

FIG. 3 schematically illustrates the configuration of a power boost control system according to embodiments;

FIG. 4 is a graph illustrating an exemplary relationship between pressure of fluid supplied by a fluid source and boost-on and boost-off of a relief device in a power boost control system according to embodiments;

FIG. 5 is a graph illustrating an exemplary relationship between pressure of fluid supplied by a fluid source and boost-on and boost-off of a relief device in a power boost control system according to embodiments;

FIG. 6 is a graph illustrating an exemplary relationship between pressure of fluid supplied by a fluid source and boost-on and boost-off of a relief device in a power boost control system according to embodiments;

FIG. 7 is a flowchart illustrating a control process implemented by a power boost control system according to embodiments;

FIG. 8 is a graph illustrating an exemplary relationship between pressure of fluid supplied by a fluid source and boost-on and boost-off of a relief device in the power boost control system illustrated in FIG. 7;

FIG. 9 is a graph illustrating an exemplary relationship between pressure of fluid supplied by a fluid source and boost-on and boost-off of a relief device in a power boost control system according to embodiments;

FIG. 10 is a graph illustrating an exemplary relationship between pressure of fluid supplied by a fluid source and boost-on and boost-off of a relief device in a power boost control system according to embodiments;

FIG. 11 is a graph illustrating an exemplary relationship between pressure of fluid supplied by a fluid source and boost-on and boost-off of a relief device in a power boost control system according to embodiments; and FIG. 12 is a graph illustrating an exemplary relationship between pressure of fluid supplied by the fluid source and boost-on and boost-off of a relief device in a power boost control system according to embodiments.

MODE FOR THE INVENTION

Hereinafter, exemplary embodiments of the present disclosure will be described in detail with reference to the accompanying drawings.

FIG. 1 is a block diagram schematically illustrating the configuration of a power boost control system according to exemplary embodiments.

A power boost control system according to the present disclosure controls boosting of power.

According to some embodiments, a power boost control system may be used in fluid-actuated machinery. According to some embodiments, a power boost control system may be used in hydraulic machinery. According to some embodiments, a power boost control system may be used in construction machinery, industrial machinery, and the like. FIGS. 2 and 3 illustrate embodiments of a power boost control system used in construction machinery. However, the present disclosure is not limited thereto, and a power boost control system is applicable to a range of machines related to fluid.

According to some embodiments, as illustrated in FIG. 1, a power boost control system includes a fluid source 100, a relief device 200, and a control device 300.

The fluid source 100 supplies fluid. For example, the fluid source 100 can supply fluid to an actuator 400.

The actuator 400 can work using pressure of fluid received from the fluid source 100.

The power boost control system controls boosting of power supplied to the actuator 400.

The relief device 200, such as a relief valve, can relieve pressure of fluid when the level of pressure of fluid supplied by the fluid source 100 exceeds a relief pressure level. For example, according to some embodiments, when the level of pressure of fluid directed toward the actuator 400 by the fluid source 100 exceeds the relief pressure level, the relief device 200 can relieve the pressure of the fluid. In this regard, according to some embodiments, the relief device 200 can communicate with a supply fluid passage 510 extending from the fluid source 100 toward the actuator 400 by way of a relief fluid passage 520.

In this specification, only the fluid source 100, the actuator 400, and the relief device 200 are illustrated as communicating with the supply fluid passage 510 to focus on core features of the present disclosure, but the present disclosure is not limited thereto. For example, in a variety of alternative embodiments, a supply fluid passage can communicate with a variety of devices. A pressure sensor 610 illustrated in FIGS. 2 and 3 may be an example thereof. In addition, a variety of devices may be provided on the supply fluid passage 510, and fluid passages that the variety of devices are provided with may be regarded as being portions of the supply fluid passage 510. An inner fluid passage of the directional control valve 620 as illustrated in FIGS. 2 and 3 may be regarded as being such a portion of the supply fluid passage 510. This may not only be applied to the supply fluid passage 510 connecting the fluid source 100 and the actuator 400 but may also be commonly applied to all fluid passages mentioned herein, including the relief fluid passage 520.

Although fluid passages mentioned herein may be entities physically independent from devices that communicate with the fluid passages, it may not be easy to physically distinguish fluid passages from devices associated therewith. For example, although fluid passages, such as hoses, pipes, or the like, connecting one device to another may be entities physically independent from the devices communicating with the fluid passages, it may not be easy to physically distinguish fluid passages from devices associated therewith. For example, in a valve block in which a plurality of valves are assembled, it may not be easy to physically distinguish internal fluid passages of the valve block from the valves.

The control device 300 can adjust a relief pressure level of the relief device 200. For example, according to some embodiments, the control device 300 can protect constitutional devices from high pressure by allowing a relatively high level of pressure to be used as the relief pressure level when a power boosting function in response to large external load is required, so that the level of pressure of fluid can be raised to a relatively higher level of, and allowing a relatively low level of pressure to be used as the relief pressure level otherwise, in ordinary times.

The relief device 200 can be connected to the control device 300 through a control fluid passage 530. It is possible to control the relief device 200 by supplying pilot pressure to the relief device 200 through the control fluid passage 530 or stopping the supply of the pilot pressure. However, the present disclosure is not limited thereto. According to some embodiments, the control device 300 can control the relief device 200 by supplying the relief device 200 with physical force other than hydraulic force, in addition to or in place of the pilot pressure. In some of such embodiments, the control fluid passage 530 between the relief device 200 and the control device 300 may be omitted.

According to some embodiments, a power boost control system may have a boost mode and a non-boost mode (i.e. a state in which the boost mode is inactive). According to some embodiments, a power boost control system may only have the boost mode without the non-boost mode. In the former embodiments, a user may select one mode between the boost mode and the non-boost mode using, for example, a first input device 630 that will be described later with reference to FIGS. 2 and 3. Additionally or alternatively, according to some embodiments, the control device 300 may autonomously convert from the non-boost mode to the boost mode by determining whether or not a power boost function is necessary with reference to, for example, operational history (e.g. the history of pressure fluctuations in fluid), an operational condition, information input by the user, and the like.

In the boost mode, at least a first level of pressure and a second level of pressure, higher than the first level of pressure, are allowed to be selectively used as a relief pressure level. Thus, in the boost mode, the relief device 200 may have a boost-off time in which the first level of pressure is used as the relief pressure level and a boost-on time in which the second level of pressure is used as the relief pressure level. In the non-boost mode, only the first level of pressure among the first level of pressure and the second level of pressure is allowed to be used as the relief pressure level. Thus, in the non-boost mode, the relief device 200 can only have a boost-off time in which the first level of pressure is used as the relief pressure level. According to some embodiments, one or more other pressure levels may also be allowed to be used as the relief pressure level. Hereinafter, embodiments in which only the first level of pressure and the second level of pressure are used as the relief pressure level will only be described for the sake of brevity. However, it will be apparent to a person having ordinary skill in the art that the following embodiments may include the use of one or more additional pressure levels as the relief pressure level.

FIG. 2 schematically illustrates the configuration of a power boost control system according to embodiments.

According to some embodiments, as illustrated in FIGS. 2 and 3, the fluid source 100 includes a hydraulic pump 110. The hydraulic pump 110 may be connected to an engine (not shown) to drive the hydraulic pump and supply fluid having a high pressure to the actuator 400.

According to some embodiments, as illustrated in FIGS. 2 and 3, the actuator 400 may include a hydraulic cylinder 410. However, the present disclosure is not limited thereto, but any other devices, such as a hydraulic motor, that work using the force of fluid supplied thereto may be used as the actuator 400. According to some embodiments, the actuator 400 can actuate working devices, such as a boom, an arm, and a bucket.

According to some embodiments, as illustrated in FIGS. 2 and 3, a power boost control system includes a directional control valve 620. The directional control valve 620 can convert a flow path of fluid supplied by the hydraulic pump 110. For example, when an expansion stroke of the hydraulic cylinder 410 is required, pressurized fluid is supplied to a bottom chamber of the hydraulic cylinder 410 through the directional control valve 620. The piston of the hydraulic cylinder 410 performs the expansion stroke using the pressure of the fluid supplied to the bottom chamber of the hydraulic cylinder 410. At this time, fluid within a piston rod-side chamber of the hydraulic cylinder 410 is discharged to a tank 640 through the directional control valve 620. In contrast, when a contraction stroke of the hydraulic cylinder 410 is required, pressurized fluid is supplied to the piston rod-side chamber of the hydraulic cylinder 410 through the directional control valve 620. The piston of the hydraulic cylinder 410 performs the contraction stroke using the pressure of the fluid supplied to the piston rod-side chamber of the hydraulic cylinder 410. At this time, fluid within the bottom chamber of the hydraulic cylinder 410 is discharged to the tank 640 through the directional control valve 620. For such operations, according to some embodiments, the directional control valve 620 may have a spool therein. A movement of the spool can cause fluid to flow though different passages within the directional control valve 620, thereby changing the flow path of fluid. According to alternative embodiments, a power boost control system may include independent metering valves. Independent operations of the independent metering valves can change flow paths of fluid. According to some embodiments, the directional control valve 620 may be a valve belonging to a valve assembly referred to as a main control valve.

According to some embodiments, as illustrated in FIGS. 2 and 3, the power boost control system includes a pilot pump 650. The pilot pump 650 can supply pilot fluid. According to some embodiments, as illustrated in FIG. 2, the pilot pump 650 can supply pilot fluid to a control valve 320 and to a remote control valve 660. According to some embodiments, the pilot pump 650 may be driven by the engine (not shown) driving the above-described hydraulic pump 110. According to alternative embodiments, the pilot pump 650 may be driven by a different engine (not shown). In general, since the pilot pump 650 is only required to supply fluid having a lower pressure than the (main) hydraulic pump 110, the pilot pump 650 may be a gear type pump or a vane pump, while the (main) hydraulic pump 110 may be a piston pump. However, the present disclosure is not limited thereto.

According to some embodiments, as illustrated in FIG. 2, the power boost control system may include the remote control valve 660. The remote control valve 660 can control the directional control valve 620. The remote control valve 660 is generally a valve device integrated with a control lever (or a control pedal) manipulated by the user, and controls the main control valve located remote therefrom. (The remote control valve 660 located within a cab, and the main control valve located outside of the cab, are separated from each other.) According to some embodiments, the remote control valve 660 may include a spool moving in response to movement of the lever (or pedal). For example, i) when the user moves the lever (or joystick) of the remote control valve 660 in a specific direction, the remote control valve 660 allows pilot fluid to be directed toward the left to the directional control valve 620 (leftward direction in the drawing), thereby move the spool within the directional control valve 620 to the right (rightward direction in the drawing). In contrast, ii) when the user moves the lever of the remote control valve 660 in the opposite direction, the remote control valve 660 allows pilot fluid to be directed toward the right to the directional control valve 620 (rightward direction in the drawing), thereby moving the spool within the directional control valve 620 to the left (leftward direction in the drawing). In addition, the spool within the remote control valve 660 is moved by different distances depending on the degrees of movement of the remote control valve 660, so that different amounts of pilot fluid pressure are applied to the directional control valve 620. Consequently, to operate the actuator 400 at a highest rate, the lever of the remote control valve 660 has to be pushed or pulled all the way so that a greatest amount of pilot pressure is applied to the directional control valve 620.

According to some embodiments, as illustrated in FIGS. 2 and 3, a pressure sensor 610 is connected to the supply fluid passage 510 extending from the hydraulic pump 110. According to some embodiments, the pressure sensor 610 can measure a pressure value of fluid supplied by the hydraulic pump 110 and provide the measured pressure value to the control device 300. According to alternative embodiments, the pressure sensor 610 may determine whether or not the level of pressure of fluid supplied by the hydraulic pump 110 is higher than a reference pressure level to be described later and then provide the result to the control device 300.

According to some embodiments, as illustrated in FIGS. 2 and 3, the relief device 200 includes a relief valve 210 communicating with the supply fluid passage 510 extending from the hydraulic pump 110. The relief valve 210 is opened when the level of pressure of fluid supplied by the fluid source 100, i.e. the level of pressure of fluid flowing through the supply fluid passage 510, exceeds a relief pressure level. In this case, a portion of fluid flowing through the supply fluid passage 510 is discharged to the tank 640 through the relief valve 210, so that pressure of fluid flowing through the supply fluid passage 510 is relieved. The relief pressure level may be changed. As described above, according to some embodiments, one of the first level of pressure and the second level of pressure, higher than the first level of pressure, may be used as the relief pressure level. The use of the first level of pressure as the relief pressure level means that a pressure of fluid in the supply fluid passage 510 is regulated not to exceed the first level of pressure. Likewise, the use of the second level of pressure as the relief pressure level means that a pressure of fluid in the supply fluid passage 510 is regulated not to exceed the second level of pressure.

First Level of Pressure Used as Relief Pressure Level (Boost-Off)

A spring 220 of the relief valve 210 applies an amount of force for closing the relief valve 210 to the relief valve 210, the amount of force being equal to a force by the first level of pressure. At the same time, fluid within the supply fluid passage 510, i.e. fluid within the relief fluid passage 520, applies an amount of pressure sufficient for opening the relief valve 210 to the relief valve 210. Thus, when the level of pressure of fluid within the supply fluid passage 510 is equal to or lower than the first level of pressure, the pressure of fluid within the supply fluid passage 510 does not overcome the force of the spring 220, so that the valve remains closed. However, when the level of pressure of fluid within the supply fluid passage 510 exceeds the first level of pressure, the pressure of fluid within the supply fluid passage 510, i.e. the pressure of fluid within the relief fluid passage 520, pushes the spring 220 to open the relief valve 210, so that the pressure of fluid within the supply fluid passage 510 is relieved.

Second Level of Pressure Used as Relief Pressure Level (Boost-On)

In addition to the pressure of fluid within the supply fluid passage 510 and the force of the spring 220, as described above, third force is applied. According to some embodiments, as illustrated in FIGS. 2 and 3, the third force may be pilot pressure. As the spring is further compressed by the pilot pressure, the relief pressure level required for opening the relief valve 210 is increased. That is, to open the relief valve 210, the amount of pressure of fluid within the supply fluid passage 510 must be increased by an amount by which the relief pressure level is increased. Whether or not to apply the pilot pressure may be controlled by the control device 300, as will be described later.

Although FIGS. 2 and 3 illustrate the embodiments in which the forces applied to the relief valve 210 are the force of the spring 220 and the pilot pressure, the present disclosure is not limited thereto. For example, according to some alternative embodiments, in place of the force of the spring 220 and the pilot pressure, another type of force may be applied to the relief valve 210.

According to some embodiments, as illustrated in FIGS. 2 and 3, the control device 300 includes a control unit 310 and a control valve 320 selectively applying pilot pressure to the relief valve 210 under the control of the control unit 310. According to some embodiments, the control unit 310 may be an electronic control unit (ECU). According to some of such embodiments, the ECU may include a central processing unit (CPU), a memory, and the like. According to some embodiments, as illustrated in FIGS. 2 and 3, the control valve 320 may be a solenoid valve. However, the present disclosure is not limited thereto. When the control unit 310 determines that the first level of pressure should be used as the relief pressure level, the control unit 310 closes the control valve 320. Then, pilot fluid supplied by the pilot pump 650 is not applied to the relief device 200. In contrast, when the control unit 310 determines that the second level of pressure should be used as the relief pressure level, the control unit 310 opens the control valve 320. Then, the pilot fluid supplied by the pilot pump 650 is applied to the relief device 200.

According to some embodiments, as illustrated in FIGS. 2 and 3, the power boost control system further includes the first input device 630. The user can selectively activate and inactivate the boost mode using the first input device 630. The first input device 630 may be a button, a touchscreen, a lever, a pedal, a dial, or the like. Additionally or alternatively, according to some embodiments, a safety lever (not shown) may be required to be in an unlocked position so that boosting is enabled. According to some embodiments, when the safety lever is in a locked position, the supply of pilot fluid or electricity is blocked (e.g. the supply of pilot fluid to the control valve 320 by the pilot pump 650 is blocked, or the application of an electrical signal to the control valve 320 is blocked), boosting may not be enabled even if the user activates the boost mode. Thus, according to these embodiments, the user is required to both convert the safety lever to an unlocked position and activate the boost mode using the first input device 630. According to some embodiments, when the safety lever is in the locked position, pilot fluid is not supplied to the remote control valve 660. Even if the remote control valve 660 is manipulated, the directional control valve 620 does not move, and thus the actuator 400 cannot be moved.

According to some embodiments, the user may set a reference pressure level, a maximum boost-on time limit, a minimum boost-off time limit, a period length, a maximum effective boost-on time limit, and the like that will be described later, using the first input device 630. Additionally or alternatively, according to some embodiments, the power boost control system may autonomously set these values or suggest these values to the user.

According to some embodiments, as illustrated in FIGS. 2 and 3, the power boost control system further includes an output device 670. The output device 670 can provide information to the user using one selected from among senses of sight, hearing, and touch. The information may indicate boost mode activation/inactivation, boost-on/off, whether or not the level of pressure of fluid exceeds the first level of pressure, and the like.

FIG. 3 schematically illustrates the configuration of a power boost control system according to embodiments.

According to some embodiments, as illustrated in FIG. 3, the power boost control system includes a second input device 680 and an electro-proportional pressure reducing valve 690, in place of the remote control valve 660 illustrated in FIG. 2.

According to some embodiments, the second input device 680 may be an electric lever, an electric pedal, or the like. The second input device 680 corresponds to the lever (or the pedal or the like) of the above-described remote control valve 660, while the electro-proportional pressure reducing valve 690 corresponds to the valve of the above-described remote control valve 660. When the user manipulates the second input device 680, an electric control signal is transmitted to the control unit 310, which in turn controls the opening or closing of the pressure reducing valve 690 and the degree of opening of the pressure reducing valve 690 by applying an electric signal to the electro-proportional pressure reducing valve 690. According to some embodiments, the electro-proportional pressure reducing valve 690 is a type of solenoid valve, in which the strength of magnetic force varies depending on the amount of current supplied. This may change the size of an opening of a spool in the electro-proportional pressure reducing valve 690, thereby adjusting the amount of pilot pressure applied to the directional control valve 620. Typically, pilot source pressure is supplied to the electroproportional pressure reducing valve and a secondary pressure is applied to the spool of the directional control valve 620. According to some alternative embodiments (e.g. in systems to which independent metering valve technology is applied), the pilot source pressure may not be necessary. Even in the case in which no pilot pump is provided, flow paths may be controlled using fluid supplied by the main pump (referred to as self-pilot).

Hereinafter, a variety of embodiments realized by varying the settings of the control device.

The most prominent characteristic of the present disclosure is to control the relief device based on time. According to some embodiments, as illustrated in FIG. 4, a length of a boost-on time and a length of a boost-off time may be limited. According to some embodiments, as illustrated in FIGS. 5 to 8, a cumulative length of at least one boost-on time over a preset period may be limited. According to some embodiments, as illustrated in FIGS. 9 to 12, a length of an effective boost-on time may be limited.

According to some embodiments, as illustrated in FIGS. 4 to 8, as a necessary condition for the second level of pressure to be used as the relief pressure level (boost-on), the level of pressure of fluid supplied by the fluid source may be required to exceed a preset reference pressure level. As a sufficient condition for the first level of pressure to be used as the relief pressure level (boost-off), the level of pressure of fluid supplied by the fluid source may be required to be equal to or lower than the reference pressure level. According to other embodiments, as illustrated in FIGS. 9 to 12, the second level of pressure may be used as the relief pressure level by default.

FIG. 4 is a graph illustrating an exemplary relationship between pressure of fluid supplied by a fluid source and boost-on and boost-off of a relief device in a power boost control system according to embodiments.

The power boost control system according to the present disclosure is intended to prevent constitutional devices from being damaged by high pressure. In this regard, according to some embodiments, as illustrated in FIG. 4, the relief device is controlled such that a length of a boost-on time, in which a second level of pressure is continuously used as a relief pressure level, is shorter than a preset maximum boost-on time limit. However, this control configuration may be in need of improvement. When individual boost-on times, even if each of their lengths is limited to the maximum boost-on time limit, are repeated to be close to each other, some devices are damaged. Thus, in addition to the limitation of the length of the boost-on time, the relief device is controlled such that a length of a succeeding boost-off time, in which the first level of pressure is continuously used as the relief pressure level, succeeding the boost-on sections, is equal to or longer than a minimum boost-off time limit.

Respective sections are as follows:

①: Boost mode is activated.

① to ②: Boosting remains off, since a sufficient condition for boost-off, that the level of pressure of fluid supplied by the fluid source should be equal to or lower than the reference pressure level (e.g. 310 bars) is satisfied, (i.e. the first level of pressure (e.g. 330 bars) is used as the relief pressure level).

② to ③: Boosting is turned on, since a necessary condition for boost-on that the level of pressure of fluid supplied by the fluid source should exceed the reference pressure level is satisfied, and the length of a boost-on time is shorter than the maximum boost-on time limit (e.g. 2 seconds) (i.e. the second level of pressure (e.g. 360 bars) is used as the relief pressure level).

③ to ④: Boosting is turned off, since the length of the continuous boost-on time (i.e. the length of section ② to ③) is equal to or longer than the maximum boost-on time limit, although the necessary condition that pressure of fluid supplied by the fluid source should exceed the reference pressure level is satisfied. Boost-off is maintained for at least the minimum boost-off time limit (e.g. 18 seconds).

According to some embodiments, as illustrated in FIGS. 4 to 8, the reference pressure level may be lower than the first level of pressure. If the reference pressure level is set to be equal to or greater than the first level of pressure, pressure relieving is performed before the pressure of fluid supplied by the fluid source exceeds the reference pressure level, so that boosting to a pressure, higher than the first level of pressure is impossible. This phenomenon may also occur when the reference pressure level is set to be very slightly lower than the first level of pressure. When the difference between the reference pressure level and the first level of pressure is extremely low, pressure relieving may unintentionally occur before the pressure sensor detects the reference pressure level and in turn, the control device controls the relief device so that the second level of pressure is used as the relief pressure level. Thus, as long as the difference is beyond the range in which such unintended instability is caused, the reference pressure level may advantageously be set to be close to the first level of pressure.

FIG. 5 is a graph illustrating an exemplary relationship between pressure of fluid supplied by a fluid source and boost-on and boost-off of a relief device in a power boost control system according to embodiments.

According to some embodiments, the control device can realize the equivalent effects by limiting a length of the boost-on time and setting a time period, as illustrated in FIG. 5, in place of limiting the length of the boost-on time and the length of the boost-off time. The latter embodiments are substantially equivalent to the former embodiments, since, when the maximum length of a boost-on time over the previously set time period is determined, the length of a boost-off time over the same time period is also determined.

In some of such embodiments, the control device can control the relief device so that the length of a boost-on time in which the second level of pressure is continuously or discontinuously used as the relief pressure level during the time period is shorter than a preset maximum boost-on time limit. According to some embodiments, the maximum boost-on time limit during the preset time period may be variously set depending on work productivity, operator preference, or the like. For example, the maximum boost-on time limit may be set to be 10% of the length of the time period.

Respective sections are as follows:

①: Boost mode is selected.

① to ②: Boosting remains off, since the sufficient condition for boost-off that the level of pressure of fluid supplied by the fluid source should be equal to or lower than the reference pressure level is satisfied.

② to ③: Boosting is turned on, since the necessary condition for boost-on that the level of pressure of fluid supplied by the fluid source should exceed the reference pressure level is satisfied, and the length of a boost-on time is shorter than the maximum boost-on time limit.

③ to ④: Boosting is turned off, since the sufficient condition for boost-off that the level of pressure of fluid supplied by the fluid source should be equal to or lower than the reference pressure level is satisfied.

④ to ⑤: Boosting is turned on, since the necessary condition for boost-on that the level of pressure of fluid supplied by the fluid source should exceed the reference pressure level is satisfied, and the cumulative length of boost-on times is shorter than the maximum boost-on time limit.

⑤ to ⑥: Boosting is turned off, since the cumulative length of the boost-on times (i.e. a total of the length of section ② to ③ and the length of section ④ to ⑤) is equal to or longer than the maximum boost-on time limit, although the necessary condition for boost-on that the level of pressure of fluid supplied by the fluid source should exceed the reference pressure level is satisfied.

FIG. 6 is a graph illustrating an exemplary relationship between pressure of fluid supplied by the fluid source and boost-on and boost-off of a relief device in a power boost control system according to embodiments.

According to some embodiments, as illustrated in FIG. 6, the control device can set a threshold time and, as a necessary condition for boost-on, require the level of pressure of fluid supplied by the fluid source to continuously exceed the reference pressure level for a period of time equal to or longer than the threshold time so that the relief pressure level is shifted from the first level of pressure to the second level of pressure. This can consequently prevent effects of noise in pressure changes. Although such limitations have been described with reference to FIG. 6, the same is applicable to the embodiments described with reference to FIGS. 4 and 5 and embodiments to be described with reference to FIGS. 7 to 12.

Respective sections are as follows:

① Boost Mode is activated.

① to ②: Boosting remains off, since the sufficient condition for boost-off that the level of pressure of fluid supplied by the fluid source should be equal to or lower than the reference pressure level is satisfied.

② to ③: The boost-off is maintained for a threshold time (e.g. 0.5 second), although the necessary condition for boost-on that the level of pressure of fluid supplied by the fluid source should exceed the reference pressure level is satisfied.

③ to ④: Boosting is turned on, since the necessary condition for boost-on that the level of pressure of fluid supplied by the fluid source should exceed the reference pressure level is satisfied, and the length of a boost-on time is shorter than a maximum boost-on time limit.

④ to ⑤: Boosting is turned off, since the sufficient condition for boost-off that the level of pressure of fluid supplied by the fluid source should be equal to or lower than the reference pressure level is satisfied.

⑤ to ⑥: The same as ② and ③.

⑥ to ⑦: Boosting is turned on, since the necessary condition for boost-on that the level of pressure of fluid supplied by the fluid source should exceed the reference pressure level is satisfied, and the cumulative length of boost-on times is shorter than the maximum boost-on time limit.

⑦ to ⑧ and ⑧ to ⑨: Boosting is turned off, since the cumulative length of the boost-on times is equal to or longer than the maximum boost-on time limit, although the necessary condition for boost-on that the level of pressure of fluid supplied by the fluid source should exceed the reference pressure level is satisfied.

FIG. 7 is a flowchart illustrating a control process implemented by a power boost control system according to embodiments, and FIG. 8 is a graph illustrating an exemplary relationship between pressure of fluid supplied by a fluid source and boost-on and boost-off of a relief device in the power boost control system illustrated in FIG. 7.

According to some embodiments, as illustrated in FIG. 7, the control device may set a time cycle in which a time period is repeated such that a plurality of time periods proceed. In some of such embodiments, each of maximum boost-on time limits of the plurality of time periods may include a base time and a carried-over time. The base times of the plurality of time periods may be equal to each other, while the carried-over time of the $(m+1)^{th}$ time period may be a difference between the maximum boost-on time limit of the $m^{th}$ time period and the cumulative length of at least one boost-on time over the $m^{th}$ time period, where the m is a natural number equal to or greater than 1.

Respective sections in FIG. 8 are as follows:

①: Boost mode is activated.

① to ②: Boosting remains off, since the sufficient condition for boost-off that the level of pressure of fluid supplied by the fluid source should be equal to or lower than the reference pressure level is satisfied.

② to ③: Boosting is turned on, since the necessary condition for boost-on that the level of pressure of fluid supplied by the fluid source should exceed the reference pressure level is satisfied, and the length of a boost-on time during the time period (e.g. 60 minutes) is shorter than a maximum boost-on time limit (e.g. 6 minutes).

③ to ④: The same as ④ to ②.

④ to ⑤: The same as ② to ③.

⑤ to ⑥ and ⑥ to ⑦: The same as ① to ②.

⑦: The difference between the maximum boost-on time limit and the cumulative length of the boost-on times (i.e. a total of the length of section ② to ③ and the length of section ④ to ⑤) is carried over to the next period (i.e. the maximum boost-on time limit of period 2 is updated). Period 2 starts.

⑦ to ⑧: The same as ① to ②.

⑧ to ⑨: The same as ② to ③.

⑨ to ⑩: The same as ① to ②.

⑩ to ⑪: The same as ② to ③.

⑪ to ⑫: Time carried over from the previous period.

⑫ to ⑬: Boosting is turned off, since the cumulative length of the boost-on times during the time period (i.e. a total of the length of section ⑧ to ⑨, the length of section ⑩ to ⑪, and the length of section ⑪ to ⑫) is equal to or longer than the maximum boost-on time limit (i.e. a total of the base time and the carried-over time), although the necessary condition for boost-on that the level of pressure of fluid supplied by the fluid source should exceed the reference pressure level is satisfied.

FIG. 9 is a graph illustrating an exemplary relationship between pressure of fluid supplied by a fluid source and boost-on and boost-off of a relief device in a power boost control system according to embodiments.

According to some embodiments, as illustrated in FIGS. 9 to 12, in the boost mode, the control device can control the relief device such that the second level of pressure is used as the relief pressure level by default. In some of such embodiments, the control device can control the relief device such that the first level of pressure is used as the relief pressure level when the length of an effective boost-on time, in which the amount of the level of pressure of fluid continuously or discontinuously exceeds a preset reference pressure level, is equal to or longer than a preset maximum effective boost-on time limit. Although the relief device is in a boost-on state, a section in which the level of pressure of fluid actually supplied by the fluid source is lower than the reference pressure level cannot be regarded as being an effective boost-on section. Thus, for more effective pressure control, effective boost-on times influential to the actual durability of devices may only be controlled.

According to some embodiments, as illustrated in FIGS. 9 to 12, the reference pressure level may be the same as the first level of pressure. However, according to alternative embodiments, the reference pressure level may be lower than the first level of pressure. According to further alternative embodiments, the reference pressure level may be greater than the first level of pressure. According to some embodiments, the amount of reference pressure level may vary depending on the setting selected by the user. Additionally or alternatively, according to some embodiments, the power boost control system may autonomously vary the reference pressure level by referring to a history of pressure fluctuations in fluid supplied by the fluid source, working conditions, and the like.

Respective sections are as follows:

①: Boost mode is activated. When the boost mode is activated, the second level of pressure is used as the relief pressure level by default.

① to ② and ② to ③: A boost-on state, as a default state, is maintained, regardless of the amount of pressure of fluid supplied by the fluid source.

③ to ④: Boosting is turned off, since the length of an effective boost-on time (i.e. the length of section ② to ③) is equal to or longer than the maximum effective boost-on time limit.

FIG. 10 is a graph illustrating an exemplary relationship between pressure of fluid supplied by a fluid source and boost-on and boost-off of a relief device in a power boost control system according to some embodiments.

According to some embodiments, as illustrated in FIG. 10, the control device can control the relief device such that the length of a succeeding boost-off time in which the first level of pressure is continuously used as the relief pressure level, succeeding a boost-on section, is equal to or longer than the previously-set minimum boost-off time limit. When individual boost-on sections are repeated to be close to each other, the durability of devices is deteriorated. Thus, similarly to the embodiments described with reference to FIG. 4, a boost-off section having a minimum length may be interposed between boost-on sections.

Respective sections are as follows:

①: Boost mode is activated. When the boost mode is activated, the second level of pressure is used as the relief pressure level by default.

① to ② and ② to ③: A boost-on state, as a default state, is maintained, regardless of the amount of pressure of fluid supplied by the fluid source.

③ to ④: Boosting is turned off, since the length of an effective boost-on time (i.e. the length of section ② to ③) is equal to or longer than the maximum effective boost-on time limit. The boost-off state is maintained for at least the minimum boost-off time limit.

④ to ⑤: The boost-on state, as a default state, is restored, since the boost-off time is equal to or longer than the minimum boost-off time limit.

FIG. 11 is a graph illustrating an exemplary relationship between pressure of fluid supplied by a fluid source and boost-on and boost-off of a relief device in a power boost control system according to some embodiments.

According to some embodiments, as illustrated in FIGS. 11 and 12, the control device sets time periods and sets maximum effective boost-on time limits corresponding to the set time periods. During each of the time periods, when the cumulative length of at least one effective boost-on time is equal to or longer than the maximum effective boost-on time limit, the relief device can be controlled such that the first level of pressure is used as the relief pressure level.

Respective sections are as follows:

①: Boost mode is activated. When the boost mode is activated, the second level of pressure is used as the relief pressure level by default.

① to ②, ② to ③, ③ to ④, and ④ to ⑤: A boost-on state, as a default state, is maintained, regardless of the amount of pressure of fluid supplied by the fluid source.

⑤ to ⑥: Boosting is turned off, since the cumulative length of the effective boost-on times (i.e. a total of the length of section ② to ③ and the length of section ④ to ⑤) is equal to or longer than the maximum effective boost-on time limit.

FIG. 12 is a graph illustrating an exemplary relationship between pressure of fluid supplied by a fluid source and boost-on and boost-off of a relief device in a power boost control system according to some embodiments.

According to some embodiments, as illustrated in FIG. 12, the control device may set a time cycle in which time periods are repeated, and each of maximum boost-on time limits of the time periods may include a base time and a carried-over time. In some of such embodiments, the same base time may be set for each of the time periods. In addition, the carried-over time of the (n+1)th time period may be a difference between the cumulative length of at least one effective boost-on times of the nth period (n is a natural number equal to or greater than 1) and the maximum effective boost-on time limit of the nth period, carried over to an (n+1)th period, when the cumulative length of the effective boost-on time of the nth period is shorter than the maximum effective boost-on time limit of the nth period.

Respective sections are as follows:

①: Boost mode is activated. Period 1 starts. When the period 1 starts, the second level of pressure is used as the relief pressure level by default.

① to ②, ② to ③, ③ to ④, ④ to ⑤, ⑤ to ⑥, and ⑥ to ⑦: A boost-on state, as a default state, is maintained, regardless of the amount of pressure of fluid supplied by the fluid source.

⑦: The difference between the maximum effective boost-on time limit and the cumulative length of the effective boost-on times is carried over to the next period (i.e. the maximum boost-on time limit of period 2 is updated). When period 2 starts, the second level of pressure is used as the relief pressure level by default.

⑦ to ⑧, ⑧ to ⑨, ⑨ to ⑩, and ⑩ to ⑪: The boost-on state, as the default state, is maintained, regardless of the amount of pressure of fluid supplied by the fluid source.

⑪ to ⑫: Time carried over from the previous period.

⑫ to ⑬: Boosting is turned off, since the cumulative length of the effective boost-on times (i.e. a total of the length of section ⑧ to ⑨, the length of section ⑩ to ⑪, and the length of section ⑪ to ⑫) is equal to or longer than the maximum effective boost-on time limit (i.e. a total of the base time and the carried-over time).

According to embodiments described with reference to FIGS. 5 to 8 and FIGS. 11 and 12, periods may start from a variety of points in time. For example, according to some embodiments, as illustrated in FIGS. 8, 11, and 12, the periods may start from points in time at which the boost mode is activated. According to alternative embodiments, as illustrated in FIGS. 5 and 6, the periods may start from points in time at which the boost-on starts and/or ends. According to further alternative embodiments, the periods may start from points in time at which the boost-off starts and/or ends. Furthermore, according to still alternative embodiments, the periods may start from any points in time. For example, referring to FIG. 8, it is possible to control the relief device such that the boost-on time is shorter than the time limit during preset periods extending back to the past from any points in time. For example, in a case in which the length of each period is 60 minutes, a maximum boost-on time limit is 6 minutes, one boost-on section extends from the point in time 50 minutes to the point of time 56 minutes after a point in time at which the boost mode is activated, and the next boost-on section extends from the point of time 1 hour and 10 minutes to the point of time 1 hour and 16 minutes after the point in time at which the boost mode is activated, as illustrated in FIG. 8, such boost-on sections are allowable when the period proceeds from the point in time at which the boost mode is activated. In contrast, such boost-on sections cannot be allowed, when the period proceeds from any points in time (for example, when the period proceeds from the point of time 40 minutes after the point in time at which the boost mode is activated).

According to exemplary embodiments, a manual boost-on in addition to the above-described (automatic) boost-on may be implemented. When the user activates a manual boost-on boost mode, the relief device is boosted for a preset period of time regardless of the pressure of fluid supplied by the fluid source and, after the lapse of the preset period of time, the boosting of the relief device is turned off. To re-boost the relief device, the user must reactivate the manual boost-on boost mode.

The invention claimed is:

1. A time-based power boost control system comprising:

a fluid source configured to supply fluid;

a relief device configured to relieve pressure of the fluid supplied by the fluid source when a level of the pressure of the fluid exceeds a relief pressure level; and a control device configured to set a time period and control the relief device such that, when a boost mode in which at least a first level of pressure and a second level of pressure, higher than the first level of pressure, are allowed to be selectively used as the relief pressure level is active, a cumulative length of at least one boost-on time over the time period in which the second level of pressure is used as the relief pressure level is shorter than a maximum boost-on time limit.

2. The time-based power boost control system of claim 1, wherein, the level of the pressure of the fluid exceeding a preset reference pressure level is a necessary condition for the second level of pressure being used as the relief pressure level.

3. The time-based power boost control system of claim 2, wherein the control device sets a threshold time, and the level of the pressure of the fluid continuously exceeding the reference pressure level for at least the threshold time is a necessary condition for the relief pressure level being shifted from the first level of pressure to the second level of pressure.

4. The time-based power boost control system of claim 2, wherein the reference pressure level is lower than the first level of pressure.

5. The time-based power boost control system of claim 1, wherein the control device sets a time cycle in which the time period is repeated such that a plurality of time periods proceed, and each of the maximum boost-on time limits of the plurality of time periods comprises a base time and a carried-over time, the base times of the plurality of time periods being equal to each other, and the carried-over time of an $(m+1)^{th}$ time period being a difference between the maximum boost-on time limit of an $m^{th}$ time period and the cumulative length of the at least one boost-on time over the $m^{th}$ time period, where m is a natural number equal to or greater than 1.

6. The time-based power boost control system of claim 1, further comprising a fluid passage extending from the fluid source, wherein the fluid source comprises a hydraulic pump of construction machinery, and the relief device comprises a relief valve connected to the fluid passage.

7. The time-based power boost control system of claim 1, wherein the control device comprises a control unit and a control valve selectively applying hydraulic pressure to the relief device under control of the control unit.

8. The time-based power boost control system claim 1, further comprising an input device by which an operator activates or in-activates the boost mode, wherein the control device controls the relief device such that, when the boost mode is in-active, only the first level of pressure of the first level of pressure and the second level of pressure is used as the relief pressure level.

9. A time-based power boost control system comprising:

a fluid source configured to supply fluid;

a relief device configured to relieve pressure of the fluid supplied by the fluid source when a level of the pressure of the fluid exceeds a relief pressure level; and a control device configured to control the relief device such that, when a boost mode in which at least a first level of pressure and a second level of pressure, higher than the first level of pressure, are allowed to be selectively used as the relief pressure level is active, the second level of pressure is used as the relief pressure level by default, and the first level of pressure is used as the relief pressure level when a cumulative length of at least one effective boost-on time in which the level of the pressure of the fluid exceeds a preset reference pressure level reaches a preset maximum effective boost-on time limit, wherein the control device sets a time period, and the maximum effective boost-on time limit for the time period, and when the cumulative length of the at least one effective boost-on time reaches the maximum effective boost-on time limit during the time period, the first level of pressure is used as the relief pressure level.

10. The time-based power boost control system of claim 9, wherein the reference pressure level is equal to the first level of pressure.

11. The time-based power boost control system of claim 9, wherein the control device controls the relief device such that a length of a boost-off time in which the first level of pressure is used as the relief pressure level is equal to or longer than a preset minimum boost-off time limit.

12. The time-based power boost control system of claim 9, wherein the control device sets a time cycle in which the time period is repeated such that a plurality of time periods proceed, and each of the maximum effective boost-on time limits of the plurality of time periods comprises a base time and a carried-over time, the base times of the plurality of time periods being equal to each other, and the carried-over time of an $(n+1)^{th}$ time period being a difference between the maximum effective boost-on time limit of an $n^{th}$ time period and the cumulative length of the at least one effective boost-on time over the $n^{th}$ time period, where n is a natural number equal to or greater than 1.

13. The time-based power boost control system of claim 9, further comprising a fluid passage extending from the fluid source, wherein the fluid source comprises a hydraulic pump of construction machinery, and the relief device comprises a relief valve connected to the fluid passage.

14. The time-based power boost control system of claim 9, wherein the control device comprises a control unit and a control valve selectively applying hydraulic pressure to the relief device under control of the control unit.

15. The time-based power boost control system claim 9, further comprising an input device by which an operator activates or in-activates the boost mode, wherein the control device controls the relief device such that, when the boost mode is in-active, only the first level of pressure of the first level of pressure and the second level of pressure is used as the relief pressure level.

* * * * *